United States Patent [19]

Aliquot et al.

[11] Patent Number: 5,044,989

[45] Date of Patent: Sep. 3, 1991

[54] CONNECTION DEVICE, IN PARTICULAR FOR ULTRAHIGH-FREQUENCY ELECTROMAGNETIC SIGNALS

[75] Inventors: Jean-Claude Aliquot, Gometz La Ville; Henri Caramelle, Breuillet, both of France

[73] Assignee: Alliance Technique Industrielle, Evry, France

[21] Appl. No.: 545,608

[22] Filed: Jun. 29, 1990

[51] Int. Cl.[5] ..... H01R 13/00

[52] U.S. Cl. ..... 439/578

[58] Field of Search ..... 439/578–585

[56] References Cited

U.S. PATENT DOCUMENTS 2,557,130 6/1951 McGee et al. ..... 439/578

3,893,743 7/1975 Wallo ..... 439/578

*Primary Examiner*—Joseph H. McGlynn

*Attorney, Agent, or Firm*—Dennison, Meserole, Pollack & Scheiner

[57] ABSTRACT

The disclosure relates to a first connector having a cylindrical side wall and a female cylindrical prong slit longitudinally in such a way as to make two flat sides. The second connector of the device includes a side wall, the inner face of which has two flat sides and a cylindrical male prong. The latter prong is connected with contact at the flat sides of the female prong, while the outer face of the side wall of the first connector is connected with contact at the two flat sides of the second connector. The play thus provided enables relative displacement of the two connectors perpendicular to the internesting axis.

23 Claims, 4 Drawing Sheets

CONNECTION DEVICE, IN PARTICULAR FOR ULTRAHIGH-FREQUENCY ELECTROMAGNETIC SIGNALS

The invention relates to the connection of two energy supply leads or conduits by nesting them one in the other.

It applies particularly, but is not limited to, leads for carrying ultrahigh-frequency electromagnetic signals, such as coaxial cables.

Generally, one skilled in the art knows that a critical problem exists when two parts connected by internesting are subjected to relative displacement along an axis perpendicular to the axis of the internesting.

This problem becomes even more acute in ultrahigh-frequency applications. Connection devices between two coaxial cables, for instance, or between a coaxial cable and a printed wiring board, or between a coaxial cable and an ultrahigh-frequency apparatus, include two parts or connectors arranged for connection to one another, each of which must meet electrical characteristics in order to limit the alteration of the signal transmitted. For the frequency band in which these connectors must function, these electrical characteristics are in particular the stationary wave ratio, the characteristic impedance, and the insertion losses. They must be maintained regardless of the relative position of the two connectors.

In the majority of cases, the connectors include shouldered cylinders of various diameters wedged concentrically and rigidly into one another. Along with the nature of the dielectric located inside these connectors, this internal geometry, which is arrived at by both complex calculations and sophisticated experimentation, contributes to attaining the requisite electrical characteristics, and the rigid wedging of the various cylinders makes it possible to avert any variation in these characteristics. Hence their manufacture and their operating condition necessitate moving the two parts toward one another approximately facing one another, in order to couple them, and once the coupling has been accomplished it is practically impossible to shift one connector transversely relative to the other, because of the rigid, locked internesting.

For certain assembly conditions, for example in printed wiring boards with a heat sink rail, or when the substrates of each connector undergo a relative displacement, for example after expansion, the connectors used must be capable of withstanding a transverse displacement after being coupled, without notable alteration of their electrical characteristics.

The principal object of the present invention is to overcome this problem.

One object of the invention is to propose a connection device that allows a relative displacement of the parts connected by internesting, along an axis perpendicular to the axis of internesting.

Another object of the invention is to permit coupling of the two parts in a given initial position, as well as their uncoupling in this position or even in the position obtained after relative displacement.

A further object of the invention, particularly in the case of transmission of electromagnetic signals, in particular ultrahigh-frequency signals, is to maintain the nature of the electrical contacts in the connection device and not notably alter the performance of the device, regardless of the relative position of the two parts.

The present invention accordingly provides a connection device, including a first hollow piece open at one end, and arranged to be inserted along an internesting axis into a second hollow piece also open at one end; these two hollow pieces may for example be also connected respectively to two leads carrying electromagnetic and in particular ultrahigh-frequency signals.

Each hollow part has a side wall, and when the first part is internested in the second, the outer face of the side wall of this first part is connected, with contact by way of a first connection zone, to a second connection zone of the inner face of the side wall of the second part; these two connection zones are arranged to be inscribed in two cylinders, the generatrices of which are substantially parallel to one another and to the internesting axis; it should be noted here that the term "cylinder" quite generally describes any surface generated by a straight line or generatrix that is displaced parallel to a fixed direction by following a fixed plane curve, or directrix, the plane of which intersects the given direction. Such a cylinder may accordingly be either a shape generated by revolution, in which case the directrix is a circle, or a prism with a polygonal base.

In a general characteristic of the invention, the second connection zone includes two flat sides, which are symmetrical with respect to an internesting connecting plane containing the internesting axis; additionally, the inner face of the side wall of the second part, as well as the outer face of the side wall of the first part, allow play in the internesting plane and substantially perpendicular to the generatrix of the cylinders, which thus allows a relative displacement of the two parts along an axis perpendicular to said generatrix and contained in the internesting plane, while maintaining the contact between the two faces.

The invention begins with the observation that the geometric characteristics of the two side walls thus defined will make it possible, with suitable arrangements, to overcome the problem presented.

When the connection involves electromagnetic and in particular ultrahigh-frequency signals, the contact between the inner and outer faces of the various walls is of the electrical type.

In this case as well, in accordance with a first embodiment of the device according to the invention, the cylinders in which the connection zones are inscribed have the same longitudinal axis of symmetry contained in the internesting plane. Moreover, since the inner face of the side wall of the first hollow part is cylindrical, this first hollow part includes a first cylindrical inner prong, substantially parallel to the wall and separated from the inner face of this wall by a dielectric; the second hollow part also includes a cylindrical inner prong, substantially facing the inner prong of the first hollow part and likewise separated from the inner face of the wall of this second hollow part by a dielectric.

One of the prongs advantageously then includes an open receptacle having two flat sides that are substantially symmetrical with respect to the axis of symmetry of the prong and arranged to be connected by internesting and with contact of the electrical type to the other inner prong, the two inner prongs conforming to a play that is parallel and at least equal to the play between the two inner and outer faces of the side walls of the two contacting parts.

Further advantages and characteristics of the invention will become more apparent from the ensuing detailed description and from the accompanying drawings, in which.

Figure 1A:
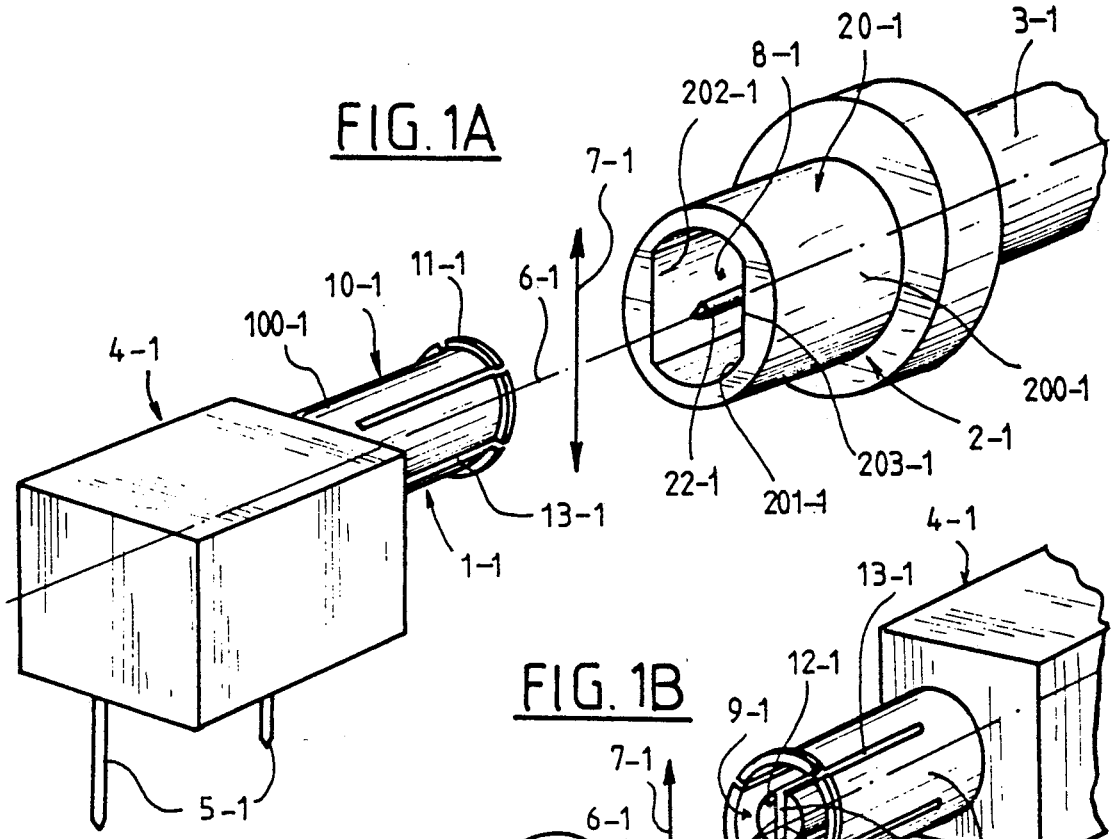
FIG. 1A is a schematic perspective view of a first embodiment of a connection device according to the invention.

The drawings essentially include elements of a certain character. As a result they are an integral part of the description and can not only serve for better comprehension of the detailed description hereinafter but also contribute as applicable to the definition of the invention.

The elements of the connection device have reference numerals that have a suffix equal to the number of the embodiment described. Elements that are similar or have a similar function in the various embodiments have the same reference numeral. When these elements are referred to generally, the suffixes corresponding to the various embodiments are omitted.

The various dimensions given below are given solely by way of example and are not limiting.

Let it be supposed now that the connection device is placed between an electric conductor capable of carrying ultrahigh-frequency signals and a printed wiring board. In the first two embodiments, this electrical conductor is a coaxial cable carrying signals in a frequency band extending up to 40 GHz.

Generally, the connection device includes two connectors arranged to be internested in one another. The first one includes a first hollow part 1, open at one end, and connected by its other end to a package 4 equipped with two pins 5 that can be soldered to the printed circuit.

The second connector includes a second hollow part 2, also open at one end, and connected at its other end to the coaxial cable 3.

The first hollow part 1 has a first cylindrical side wall 10, having a longitudinal axis of symmetry 6. This side wall is slit longitudinally with slits 13, which thus lend it a certain crosswise elasticity.

The second hollow part 2 also has a cylindrical side wall 20, having the same longitudinal axis of symmetry as the side wall of the first hollow part. This axis of symmetry thus constitutes the internesting axis of the two connectors. The inner face 201 of this side wall 20 includes two parallel longitudinal flat sides 202, 203, disposed symmetrically with respect to a plane containing the internesting axis, or internesting plane.

The material constituting the side walls of the two hollow parts is a material that is an electrical conductor with elastic properties; it may for instance be stainless steel, or copper alloy which may have a base of beryllium, and it may or may not be coated with precious metals.

The outer face 100 of the side wall 10 of the first hollow part includes projecting ribs 11 in the vicinity of its free end which are intended to be connected with contact on the two flat sides of the inner face 201 of the side wall of the second hollow part. Hence these ribs form part of a first connection zone, while the flat sides form part of a second connection zone. One skilled in the art will note immediately that when the first part is nested in the second, the combination of the elasticity of the side wall of this first hollow part and the existence of the ribs contribute to assuring good electrical contact between the connectors. It can thus be confirmed that the first connection zones (the ribs) is inscribed in a first cylinder, which is in fact the cylinder in which the two flat sides are inscribed.

The outer face 100 of the side wall of the first hollow part and the inner face 201 of the side wall of the second hollow part conform to a play j contained in the internesting plane and substantially perpendicular to the internesting axis 6. This play then allows a relative displacement of the two connectors along the axis 7 perpendicular to the internesting axis 6. It is understood that this play is at least equal to the maximum relative displacement desired for the two connectors.

The first hollow part 1 also includes a first cylindrical inner prong 12, the longitudinal axis of symmetry of which substantially coincides with the internesting axis 6. This inner prong 12 is open and is longitudinally slit in such a way as to make two other flat sides 120, 122, which are symmetrical with one another and define a receptacle 122 that also has a certain elasticity. This inner prong 12 is separated from the inner face 101 of the side wall 10 by a dielectric 9, which here is air.

The second hollow part 2 also includes a cylindrical inner prong 22, the longitudinal axis of symmetry of which substantially coincides with the internesting axis. This inner prong 22 is thus capable of insertion with contact into the receptacle 122 of the inner prong 12, in such a way as to assure the electrical continuity of the conductor on the inside of the cable 3. These two inner prongs likewise allow play as indicated at js that is parallel to and at least equal to the play j.

Figure 1B:
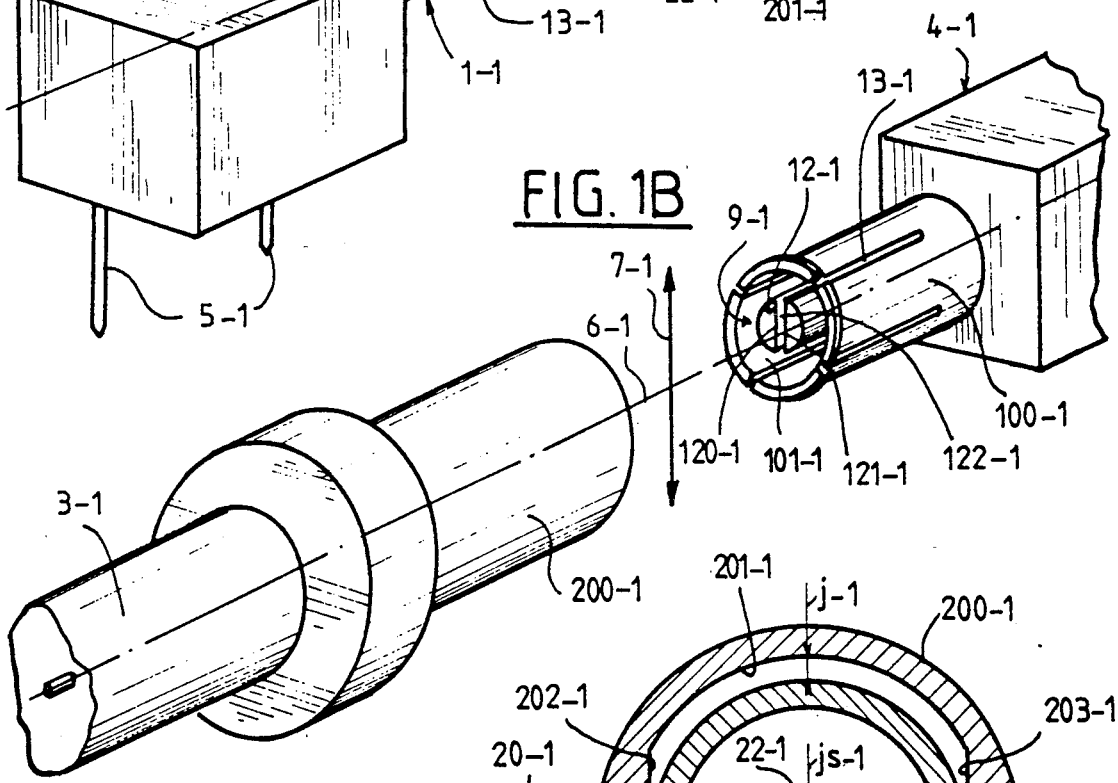
FIG. 1B is a schematic perspective view from another angle of the connection device of FIG. 1A.
Figure 1C:
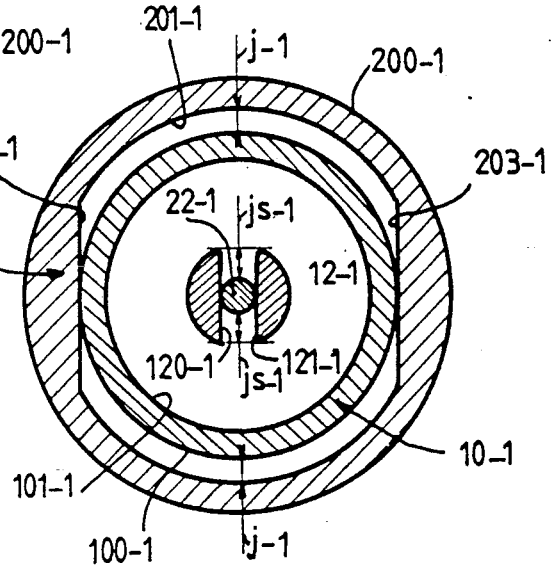
FIG. 1C is a schematic sectional view of the connection device of FIGS. 1A and 1B once they have been assembled.

Turning more particularly now to FIGS. 1A–1C, the first embodiment of the device according to the invention will be described.

In this embodiment, the side wall 10-1 of the first hollow part, which is approximately 3.5 mm in length, is generated by revolution about the internesting axis 6-1 and has an outer diameter slightly less than 2.8 mm. The ribs 11-1 project over the circumference of the free end of the outer face 100-1 of this side wall.

The outer face 200-1 of the side wall 20-1 of the second hollow part is a cylinder generated by revolution about the internesting axis 6-1, and is approximately 4 mm in diameter and approximately 7 mm in length.

The two flat sides 202-1 and 203-1 have a height of approximately 0.7 mm, are spaced apart by approximately 2.8 mm, and are connected to one another by two symmetrical barrel vaults having a radius of approximately 1.4 mm.

The inner prong 12-1 of the first hollow part is a cylinder generated by revolution, approximately 1 mm in diameter, while the inner prong 22-1 of the second hollow part is a cylinder generated by revolution, having a diameter of approximately 0.5 mm, terminating in a point.

The play allowed as indicated at j-1 and js-1 is substantially equal to 0.6 mm, that is, such a device allows a clearance of ±0.3 mm on either side of the internesting axis 6-1.

Figure 2A:
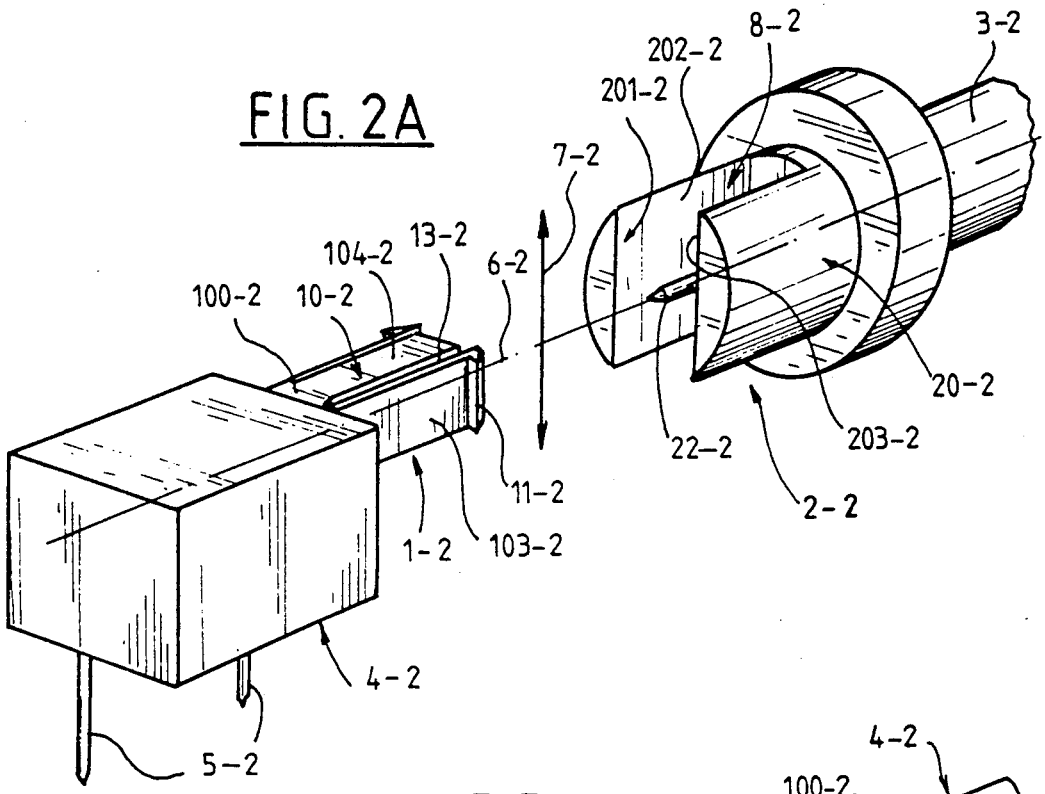
FIGS. 2A and 2B are two schematic perspective views from two different angles of a second embodiment of the device according to the invention.
Figure 2B:
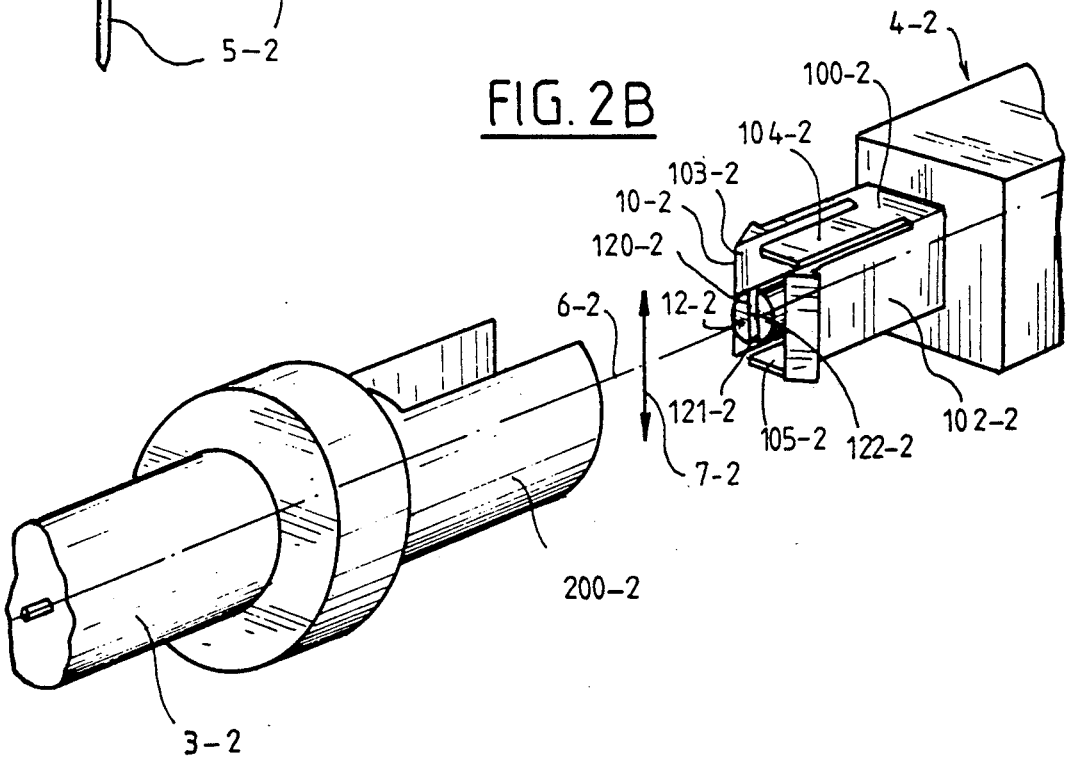

Turning now more particularly to FIGS. 2A and 2B, the second embodiment of the device according to the invention will be described.

The side wall 20-2 of the second hollow part, which is approximately 7 mm in length, is slit longitudinally into two identical portions, over a length of approximately 4 mm. The two edges of the thus-constituted slit form the two flat sides 202-2 and 203-2. These two flat sides are spaced apart by 2.8 mm, and the cylinder generated by revolution in which the outer face 200-2 of the side wall is inscribed has a diameter of approximately 4 mm.

The inner prong 22-2 is identical to that described in the foregoing embodiment.

The side wall 10-2 of the first hollow part 1-2 includes two lateral plates 102-2, 103-2, which are parallel to the flat sides 202-2 and 203-2 and are spaced apart from one another by a distance of approximately 2 mm. This side wall 10-2 also includes an upper plate 104-2 and a lower plate 105-2; the four plates of this side wall then form a rectangular parallelepiped, the axis of symmetry of which is the internesting axis 6-2.

Each lateral plate 102-2 and 103-2 includes a rib extending crosswise at the level of its free end. The side wall 10-2 includes four slits 13-2 made over the majority of its length at the intersection of each of the four plates.

The inner prong 12-2 is identical to the inner prong 12-1 of the first embodiment.

It is appropriate to note here that the two upper and lower plates 104-2 and 105-2 are not actually indispensible. It would in fact be possible to imagine that the first hollow part would include only the two lateral plates that come into contact with the two flat sides of the second hollow part.

In the two embodiments described above, when the first hollow part is internested in the second hollow part, the nature of the dielectric and of the geometrical characteristics of the connection device are such that the electrical characteristics of the type referred to above are substantially identical, regardless of the position of the first hollow part with respect to the second hollow part.

Additionally, the two parts may be coupled or uncoupled regardless of their relative position.

Figure 3A:
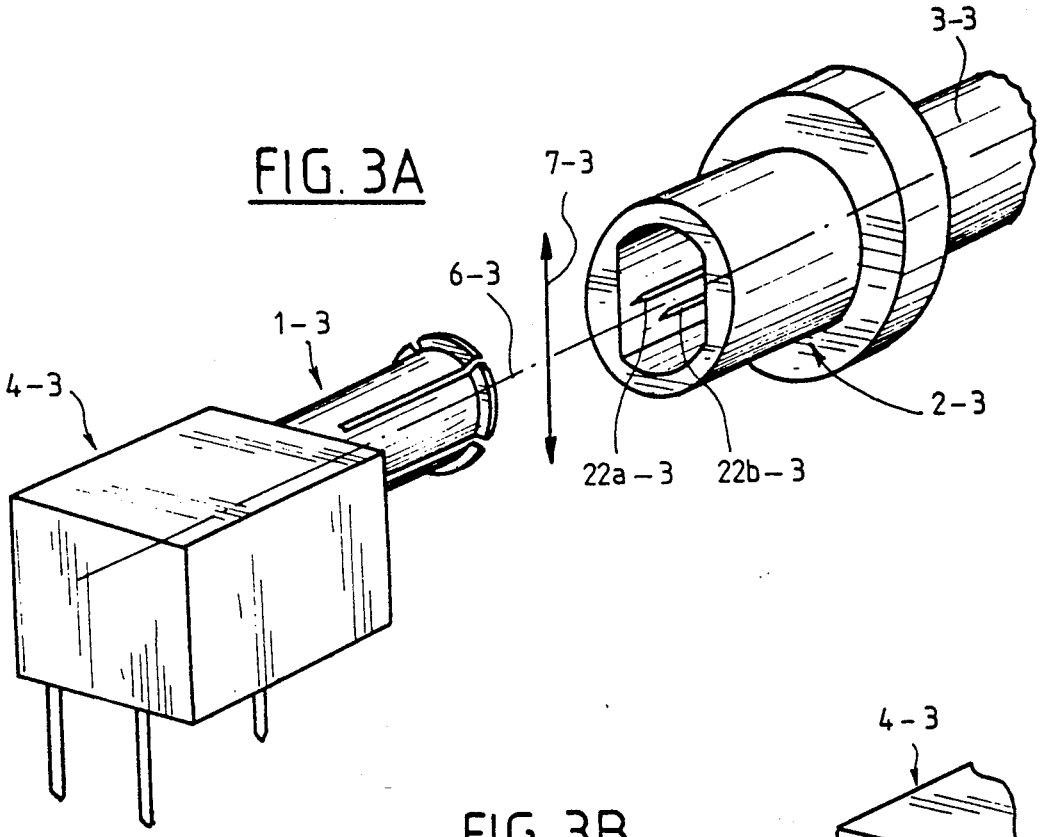
FIGS. 3A and 3B are likewise two schematic respective views from two different angles of a third embodiment of the device according to the invention.
Figure 3B:
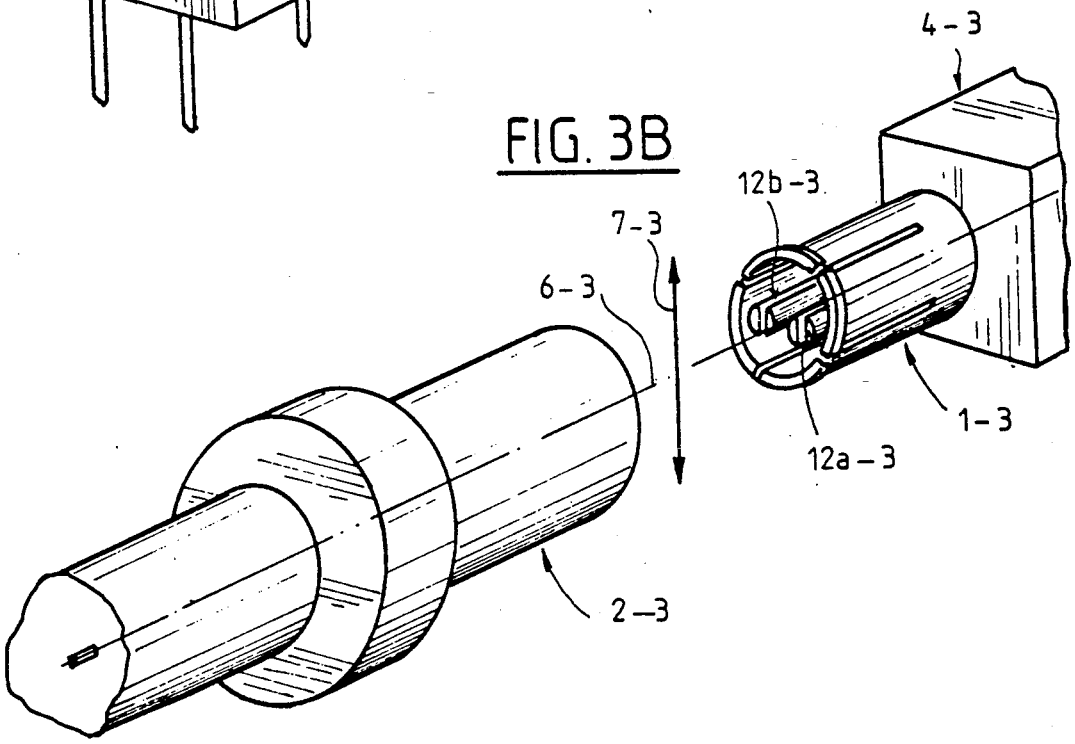

The device according to the invention also makes it possible to connect a bifilar shielded cable to a printed wiring board, that is, a cable having an outer conductor surrounding two inner conductors. A connection device of this type is shown in FIGS. 3A and 3B.

The side walls of the first and second hollow parts are identical to those described in the first embodiment. Contrarily, on its interior, the second hollow part includes two identical parallel inner prongs 22a-3, 22b-3, which are of a cylindrical shape generated by revolution and are disposed symmetrically with respect to the internesting axis 6-3. Each inner prong has a diameter of approximately 0.4 mm.

As a consequence, the first hollow part 1–3 includes two identical cylindrical inner prongs 12a-3, 12b-3, which are disposed symmetrically with respect to the internesting axis and face the inner prongs 22a-3 and 22b-3, respectively. Each of these inner prongs 12a-3 or 12b-3 have a structure analogous to that described for the inner prong 12-1 of the first embodiment. However, their diameter is on the order of 0.8 mm.

Thus the two prongs 22a-3 and 22b-3 are internested with contact in the two prongs 12a-3 and 12b-3, in such a way as to assure the electrical continuity of the two inner conductors of the bifilar shielded cable 3—3. Relative displacement can always be effected along the axis of displacement 7-3.

It is understood that the number of inner prongs inside the hollow parts is not limiting, as long as their bulk is compatible with the geometric and electrical characteristics required for the connection device.

Figure 4:
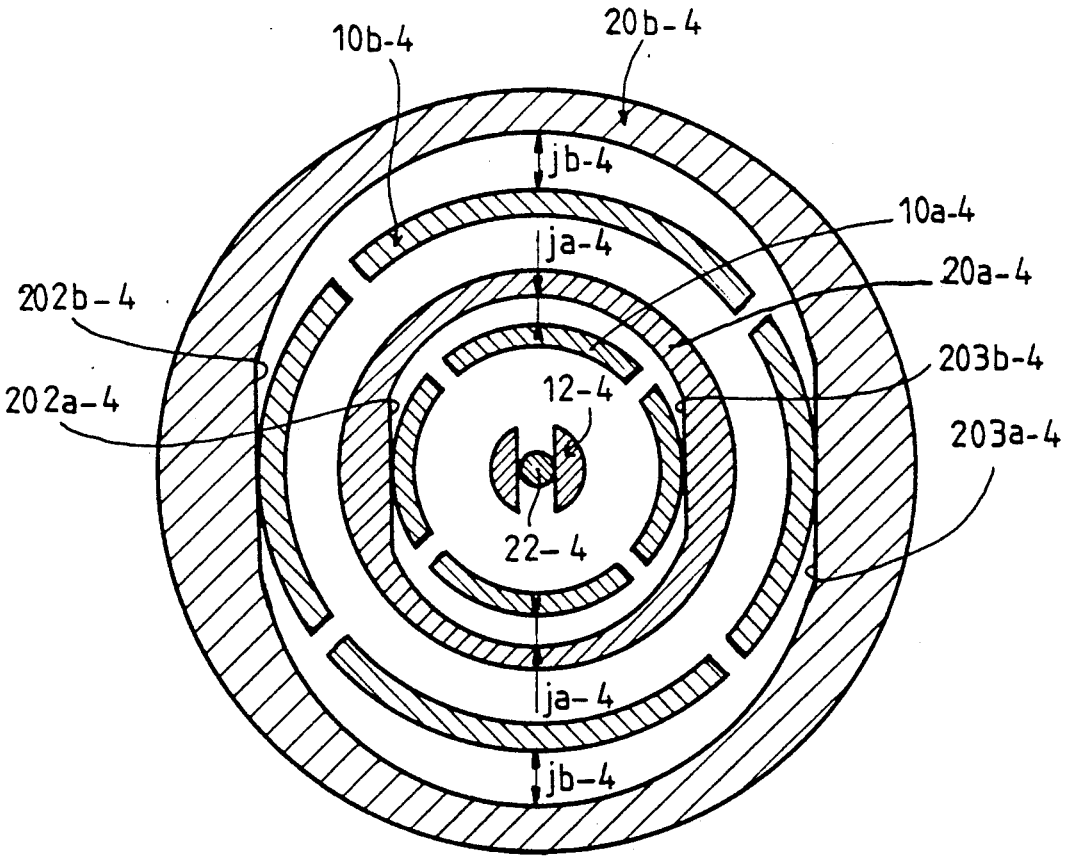
FIG. 4 is a schematic cross section of a fourth embodiment of a connection device according to the invention once it has been assembled.

It is also possible to connect a triaxial cable to a printed wiring board, that is, a cable including one inner conductor surrounded by two outer conductors. A schematic cross section of such a connection device is shown in FIG. 4.

The first hollow part includes a supplementary side wall 10b-4, disposed substantially concentrically with the first side wall 10a-4 toward the outer face of this latter wall, that is, in the present case, surrounding it. The outer diameter of the cylinder of revolution forming the outer face of this supplementary wall 10b-4 is on the order of approximately 6.3 mm. These two side walls are separated by a dielectric, which once again in the present case is air.

The second hollow part also includes a supplementary side walls 20b-4 disposed substantially concentrically with the side wall 20a-4, toward the outer face of this latter wall, or in other words surrounding it. On its inner face this supplementary side wall 20b-4 includes two supplementary flat sides 202b-4, 203b-4, which are respectively parallel to the two flat sides 202a-4 and 203a-4 of the side wall 20a-4. These two supplementary flat sides, disposed symmetrically with respect to the internesting axis, are spaced apart by 6.3 mm, and the cylinder of revolution forming the outer face of the supplementary wall 20b-4 has a diameter of approximately 8.5 mm. The dielectric separating the side wall 20a-4 from the side wall 20b-4 of the second hollow part is again air.

The outer face of the side wall 10b-4 of the first hollow part, and the inner face of the side wall 20b-4, both allow play jb-4 that is substantially parallel and at least equal to play ja-4 separating the side wall 10a-4 from the side wall 20-4.

It is understood that the outer face of the side wall 10b-4 of the first hollow part also includes a connection zone, not shown in FIG. 4, that comes into contact at the two flat sides 202b-4 and 203b-4, which thus allows the relative displacement of the two hollow parts along an axis perpendicular to the internesting axis.

It is also understood that only a single supplementary side wall has been shown here for the first and second hollow parts. This number is not limiting. It is equally conceivable for such a connection of the triaxial type to be configured with a structure analogous to that of the second embodiment.

The invention is not limited to the embodiments described above but also encompasses any variants, in particular the following:

- it has proved particularly advantageous for the inner prong of the second hollow part to be internested in the receptacle of the inner prong of the first hollow part; however, the converse could also be imagined;
- when the directrix of the cylinder in which the connection zone of the side wall of the first hollow part is inscribed is a polygon, the minimum requisite condition is that the polygon have two sides that are symmetrical with respect to the internesting axis, and these sides must be substantially parallel to the two flat sides of the side wall of the second hollow part;

the dielectric used inside the connectors may be different from air, as long as it makes it possible to assure the electrical characteristics required without preventing the relative displacement of the connectors;

the connection device according to the invention allows the relative displacement of two internested parts along at least one direction parallel to the internesting axis;

the particular application provided here has been that for carrying ultrahigh-frequency signals. The connection device could also be used for connecting two conduits for carrying a fluid, which presents problems of comparable magnitude. Then, adequate sealing means would have to be provided. One skilled in the art will also understand in this case that the complexity of reducing such a connection device to practice is less then that encountered particularly in ultrahigh-frequency applications, because in that case the constraints in terms of electrical characteristics that the connection device must meet are absent.

It is understood that some of the means described above may be omitted, in any variants where they are of no use.

We claim:

1. A connection device, including a first hollow part, open at one end, having a first side wall and arranged to be inserted along an internesting axis into a second hollow part, which is open at one end, and having a second side wall, an outer face of the first side wall being arranged for connection with contact at an inner face of the second side wall, and said outer face including a first connection zone that can be inscribed in a first cylinder the generatrix of which is substantially parallel to the internesting axis, while said inner face includes a second connection zone that can be inscribed in a second cylinder having a generatrix substantially parallel to the internesting axis, characterized in that the second connection zone includes two principal flat sides, which are symmetrical with respect to an internesting plane containing the internesting axis, and that said inner and outer faces conform to allow a principal play contained in the internesting plane and substantially perpendicular to said generatrix, which allows a relative displacement of the two parts along an axis perpendicular to said generatrix and contained in the internesting plane, while maintaining the contact between the two faces.

2. The device as defined by claim 1, characterized in that the first and second cylinders have a first longitudinal axis of symmetry contained in the internesting plane.

3. The device as defined by one of claims 1 or 2, characterized in that the first and second hollow parts are each connected in a region opposite their open end to leads carrying electromagnetic signals, and that the contact between said inner and outer face is of the electrical type.

4. The device as defined by claim 1 characterized in that the first side wall includes longitudinal slits open at the level of the open end of the first hollow part.

5. The device as defined by claim 2 characterized in that the first side wall has an inner face that is inscribed in a third cylinder substantially parallel to the first cylinder; that the first hollow part includes a first inner cylindrical prong having a second longitudinal axis of symmetry substantially parallel to said first axis of symmetry, and separated from the inner face of the first wall by a first dielectric, while the second hollow part includes a second cylindrical inner prong, having an axis of symmetry substantially coinciding with said second axis of symmetry and separated from the inner face of the second wall by a second dielectric; and that one of the first and second inner prongs includes an open receptacle having two secondary flat sides that are substantially symmetrical with respect to said second axis of symmetry and substantially parallel to the two principal flat sides and are capable of being connected with contact of the electrical type to the other inner prong, the first and second inner prongs conforming to a secondary play (js) that is parallel and at least equal to said principal play (j).

6. The device as define by claim 5, characterized in that the first and second prong are inscribed respectively in two cylinders generated by revolution.

7. The device as define by claim 5, characterized in that the electromagnetic signals are ultrahigh-frequency signals.

8. The device as defined by claim 5, characterized in that the first and second dielectrics are air.

9. The device as defined by one of claims 5 or 8, characterized in that the second inner prong is internested in the receptacle of the first inner prong.

10. The device as defined by one of claims 2, 5 or 8, characterized in that the directrix of the first cylinder is a circle.

11. The device as defined by one of claims 2, 5 or 8, characterized in that the directrix of the first cylinder is a polygon having two sides symmetrical with respect to the first axis of symmetry and substantially parallel to the two principal flat sides.

12. The device as defined by claim 11, characterized in that the polygon is a rectangle.

13. The device as defined by one of claims 1, 2, 5 or 8, characterized in that the first connection zone includes projecting ribs on at least a portion of the outer face of the first side wall.

14. The device as defined by claim 13, characterized in that the first side wall is cylindrical and generated by revolution about the first axis of symmetry, and that the ribs are located on the circumference of the open end of this first side wall.

15. The device as defined by claim 13, characterized in that the first side wall includes at least two first plates (102-2, 103-2) which are parallel to one another and to the principal sides, and that the ribs (11-2) extend crosswise on the first two plates at the level of their respect free ends.

16. The device as defined by claim 15, characterized in that the first side wall includes two supplementary parallel plates (104-2, 105-2), which are substantially perpendicular to the first two plates, the four plates forming a rectangular parallelepiped.

17. The device as defined by claim 2, characterized in that the inner face of the second side wall (20-1) includes two vaults respectively connecting the four longitudinal edges of the two principal flat sides.

18. The device as defined by one of claims 2, 5, 8, 11 or 17 characterized in that the second side wall (20-2) is slit over at least a portion of its length into two identical portions, the two principal flat sides forming the two edges of the thus-constituted slit.

19. The device as defined by claim 5, taken in combination with claim 3, characterized in that the first and second axes of symmetry substantially coincide.

20. The device as defined by claim 19, characterized in that at least one of the carrying means is a coaxial cable.

21. The device as defined by claim 19, characterized in that the first hollow part includes at least a third side wall (10b-4), substantially concentric with and outside the first side wall; that the second hollow part includes a fourth side wall (20b-4), substantially concentric with and outside the second side wall and on its inner face having two supplementary flat sides that are parallel to the two principal flat sides;

that the outer face of the third side wall is capable of being connected with electrical contact at the two supplementary flat sides;

that the outer face of the third side wall (10b-4) and the inner face of the fourth side wall (20b-4) conform with a supplementary play (jb-4) substantially parallel to an at least equal to the principal play (ja-4);

and that at least one of the carrying means includes one inner conductor surrounded by at least two peripheral concentric conductors.

22. The device as defined by claim 5, characterized in that the first hollow part includes at least one supplementary cylindrical inner prong, parallel to the first cylindrical inner prong, and that the second hollow part includes at least one second supplementary cylindrical inner prong, parallel to the second cylindrical inner prong, one of the first and second supplementary cylindrical prongs being capable of internesting with contact in the other supplementary prong, and that at least one of the carrying means includes one outer conductor surrounding at least two inner conductors.

23. The device as defined by claim 22, characterized in that the first inner prong and the first supplementary inner prong are symmetrical with respect to the internesting plane.

* * * * *